US009527309B2

(12) United States Patent
Toya

(10) Patent No.: US 9,527,309 B2
(45) **Date of Patent: *Dec. 27, 2016**

(54) LIQUID DISCHARGING APPARATUS

(71) Applicant: SEIKO EPSON CORPORATION, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/218,531

(22) Filed: Mar. 18, 2014

(65) Prior Publication Data

US 2014/0290571 A1 Oct. 2, 2014

(30) Foreign Application Priority Data

Mar. 27, 2013 (JP) ..... 2013-065802

(51) Int. Cl.

| | |
|---|---|
| ***B05B 7/06*** | (2006.01) |
| ***B05C 13/02*** | (2006.01) |
| ***B05C 11/00*** | (2006.01) |
| ***B41J 11/00*** | (2006.01) |
| ***B41J 2/155*** | (2006.01) |
| ***B41J 15/04*** | (2006.01) |

(52) U.S. Cl.

CPC ..... *B41J 11/002* (2013.01); *B41J 2/155* (2013.01); *B41J 15/04* (2013.01)

(58) Field of Classification Search

USPC ..... 118/58, 66, 68, 712, 663, 686; 427/4, 5, 427/9, 101, 102; 399/390, 400; 347/4, 5, 9, 101, 347/102, 19

See application file for complete search history.

(56) References Cited

U.S. PATENT DOCUMENTS

| | | | | |
|---|---|---|---|---|
| 5,453,777 | A | 9/1995 | Pensavecchia et al. | |
| 7,510,256 | B2 | 3/2009 | Guarino et al. | |
| 8,632,145 | B2 | 1/2014 | Madigan et al. | |
| 9,073,368 | B2 * | 7/2015 | Toya | B41J 15/046 |
| 2001/0015746 | A1 * | 8/2001 | Yosimura et al. | 347/102 |
| 2011/0050824 | A1 * | 3/2011 | Toya et al. | 347/102 |
| 2011/0261131 | A1 * | 10/2011 | Eve et al. | 347/104 |
| 2013/0249992 | A1 * | 9/2013 | Katagami et al. | 347/16 |

FOREIGN PATENT DOCUMENTS

| | | |
|---|---|---|
| JP | 08-282072 | 10/1996 |

* cited by examiner

*Primary Examiner* — Yewebdar Tadesse
(74) *Attorney, Agent, or Firm* — Workman Nydegger

(57) ABSTRACT

Provided is a liquid discharging apparatus that includes a supporting portion that supports a medium, a liquid discharging portion that discharges liquid onto the medium which is transported on the supporting portion, and a drying portion that has a drying path through which the medium passes and dries the liquid landing on the medium, in which a length of the drying path is variable.

7 Claims, 8 Drawing Sheets

LIQUID DISCHARGING APPARATUS

BACKGROUND

1. Technical Field

The present invention relates to a liquid discharging apparatus.

2. Related Art

A printing apparatus which prints an image on a transported medium has been developed. A certain type of the printing apparatus described above performs image forming in a state where a medium is wound around a roller multiple times.

A thermal transfer recording method in which an image is recorded on an image receiving material which is transported in a state where the image receiving material is wound around a platen roller twice in an oblique direction with respect to a multi-ink sheet has been disclosed in JP-A-8-282072.

In the case of a liquid discharging apparatus in which various types of liquid droplets are discharged onto a medium, it is necessary to appropriately dry the liquid droplets landing on the medium. Although a liquid discharging apparatus in which ink discharged in an ink discharging process is collectively dried has been proposed as an example of the liquid discharging apparatus described above, this has a problem in that it is necessary to set a drying portion to have high drying capacity. For this reason, it is necessary to apply an adequate heat quantity when the medium is dried.

SUMMARY

An advantage of some aspects of the invention is that an adequate heat quantity is applied when a medium is dried.

According to an aspect of the invention, there is provided a liquid discharging apparatus that includes a supporting portion that supports a medium, a liquid discharging portion that discharges liquid onto the medium which is transported on the supporting portion, and a drying portion that has a drying path through which the medium passes and dries the liquid landing on the medium, in which a length of the drying path is variable.

Other aspects of the invention will be made clear by this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
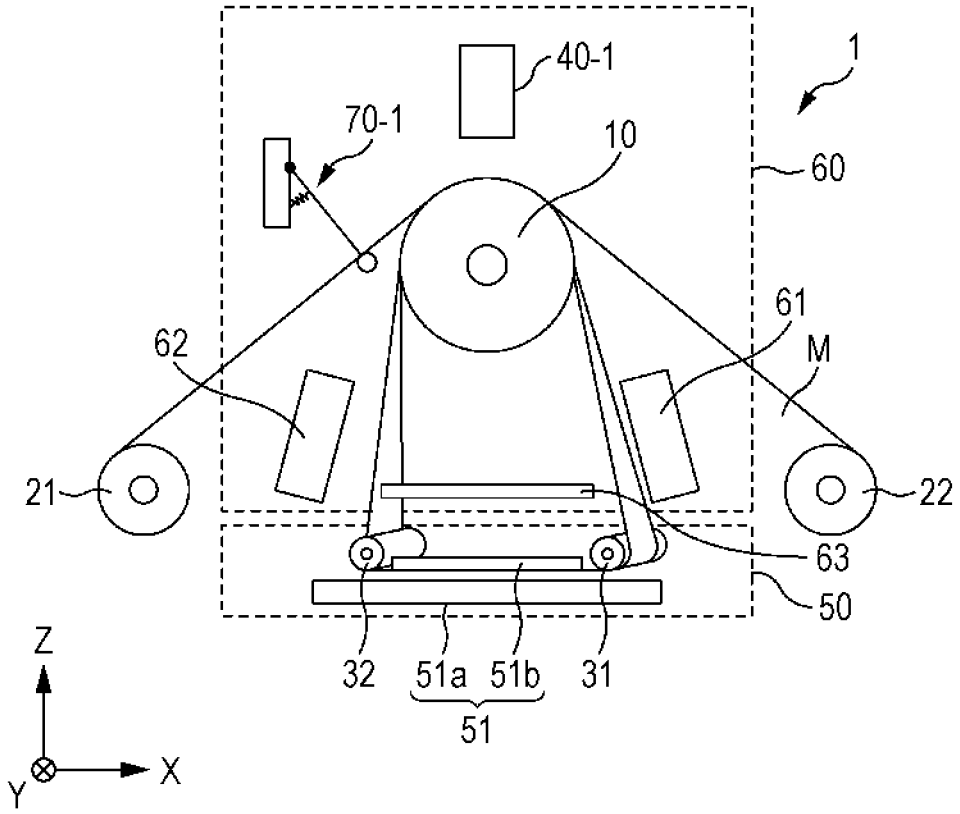
FIG. 1 is a schematic side view of an ink jet printer in an embodiment.

At least the following matters will be clearly understood by this specification and the accompanying drawings. That is, there is provided a liquid discharging apparatus that includes a supporting portion that supports a medium, a liquid discharging portion that discharges liquid onto the medium which is transported on the supporting portion, and a drying portion that has a drying path through which the medium passes and dries the liquid landing on the medium, in which a length of the drying path is variable.

In this case, the length of the drying path is variable, and thus it is possible to apply the heat quantity adequate for drying the medium.

In the liquid discharging apparatus, it is preferable that the supporting portion include a rotating drum which transports the medium in a state where the medium is wound around an outer peripheral surface of the rotating drum and that a first roller which directs the medium which passes through the rotating drum to the drying path and a second roller which directs the medium which passes through the drying path to the rotating drum again be provided. Furthermore, it is preferable that the drying path be a transport path of the medium, which extends between the first roller and the second roller, and the length of the drying path be changed in a manner that a distance between the first roller and the second roller is changed.

In this case, it is possible to adjust the heat quantity applied to the medium in such a manner that the distance between the first roller and the second roller is changed.

In the liquid discharging apparatus, it is preferable that a length of the drying path, which is adequate for drying the liquid, be acquired by analyzing received image data of a print job, and then the distance between the first roller and the second roller be controlled in accordance with the acquired length of the drying path.

In this case, when, on the basis of the image data, it is determined that an ink amount is large, it is possible to set an extended length of the drying path. Furthermore, when it is determined that the ink amount is small, it is possible to set a shortened length of the drying path.

In the liquid discharging apparatus, it is preferable that an angle of an axis of the first roller and an angle of an axis of the second roller be shifted with respect to a shaft of the rotating drum, and thus the medium be able to be wound in an axial direction of the rotating drum multiple times.

In this case, it is possible to provide the liquid discharging apparatus in which the medium is wound around the rotating drum multiple times. In addition, the liquid discharging apparatus can be reduced in size.

In the liquid discharging apparatus, it is preferable that the liquid discharging portion include a first liquid discharging portion which discharges a first liquid onto the medium and a second liquid discharging portion which discharges a second liquid onto the medium, and that the drying portion include a first drying portion that dries the first liquid landing on the medium and a second drying portion that is disposed further on a downstream side of the medium transport path than the first drying portion and dries the second liquid landing on the medium. Furthermore, it is preferable that a length of the drying path of the first drying portion be shorter than a length of the drying path of the second drying portion.

The first liquid passes through the second drying portion after being dried by the first drying portion. Thus, the first liquid is dried again. Accordingly, the first liquid can eventually be dried appropriately even when the length of the drying path of the first drying portion is shortened.

In the liquid discharging apparatus, it is preferable that a heat quantity applied to the medium in the drying path of the first drying portion be equal to or more than a heat quantity by which the liquid is prevented from being blurred when the second liquid lands on the first liquid landing on the medium.

In this case, the liquid is prevented from being blurred even when the second liquid lands on the first liquid. Thus, it is possible to improve an image quality in a case where, for example, ink is used as the first liquid and the second liquid.

In the liquid discharging apparatus, it is preferable that the length of the drying path be changed in accordance with a type of the medium.

In this case, it is possible to change the heat quantity applied to the medium in accordance with the type of the medium, it is possible to adjust the thermal effect for each medium, which is caused by heating.

In the liquid discharging apparatus, it is preferable that a distance between a heat source and the medium be variable in the drying portion.

In this case, it is possible to more easily adjust the heat quantity applied to the medium.

Embodiment

Figure 2:
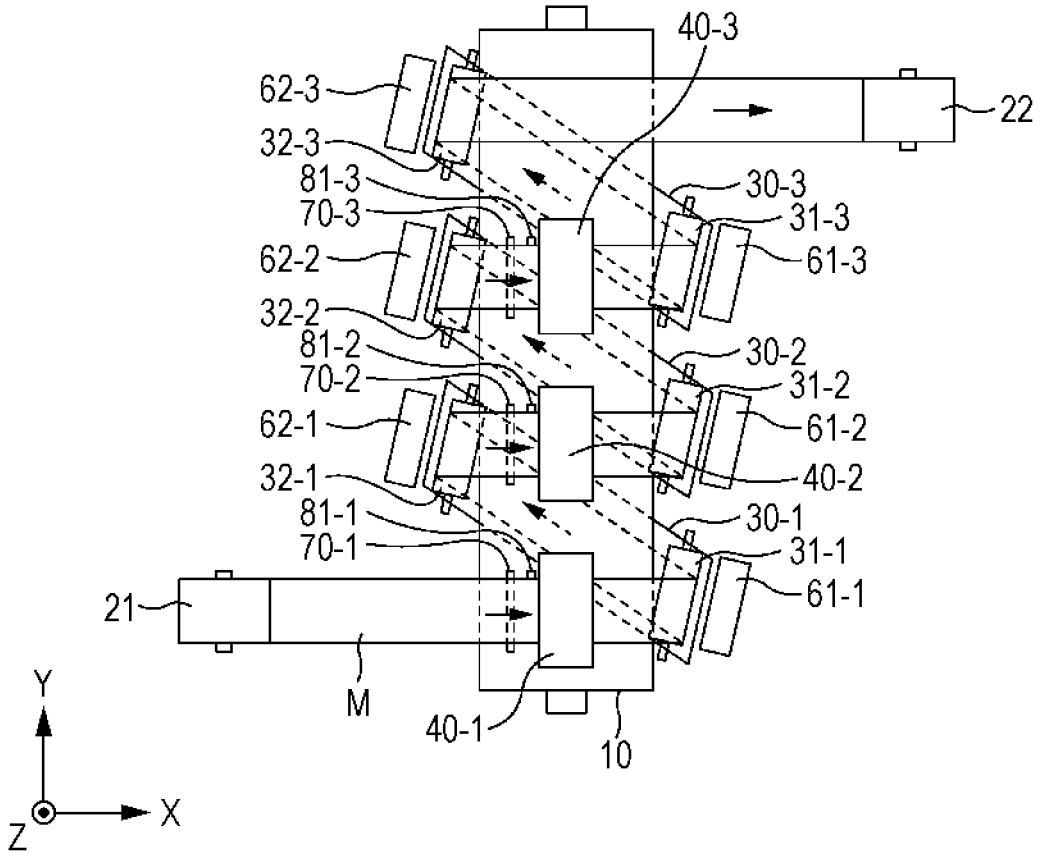
FIG. 2 is a schematic plan view of the ink jet printer in the embodiment.
Figure 3:
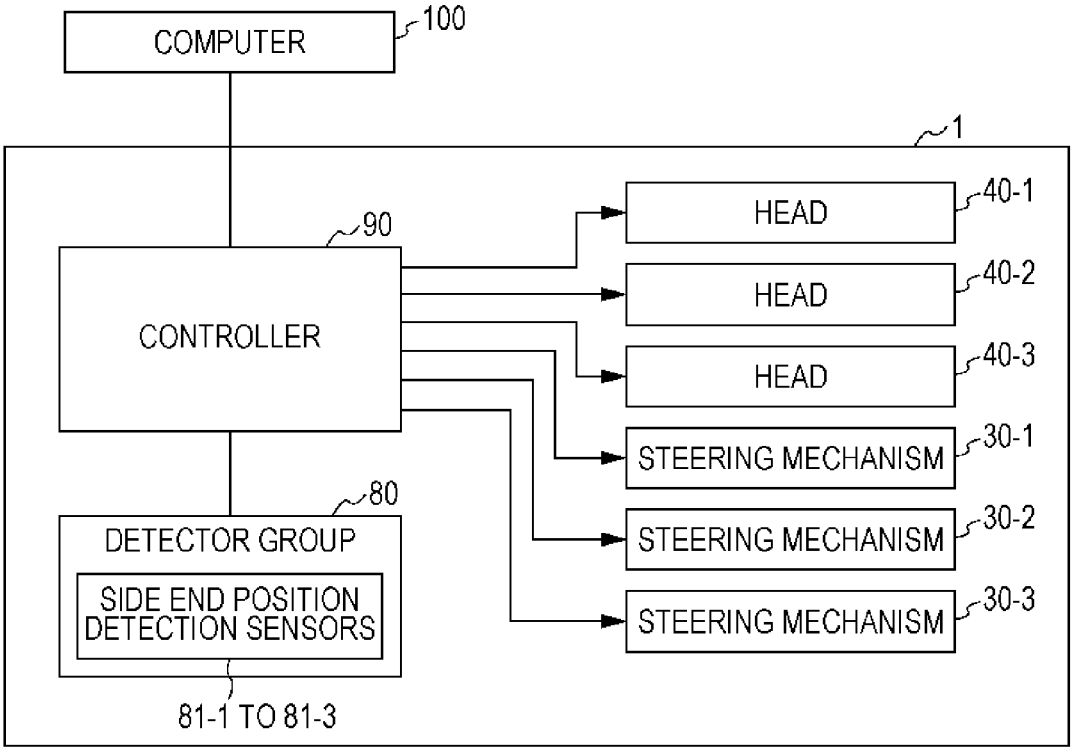
FIG. 3 is a block diagram of the ink jet printer in the embodiment.

FIG. 1 is a schematic side view of an ink jet printer 1 according to the invention. FIG. 2 is a schematic plan view of the ink jet printer 1 according to the invention. FIG. 3 is a block diagram of the ink jet printer 1 according to the invention. Hereinafter, a schematic configuration of the ink jet printer 1 in the embodiment will be described with reference to the accompanying drawings.

For convenience of description, an X axis, a Y axis, and a Z axis are illustrated in FIGS. 1 and 2. The Z-axis direction shows a vertical direction of the ink jet printer 1, and the X axis and the Y axis show a planar direction.

In the accompanying drawings, a reference numeral "1" is given, after the hyphen "-", to each component corresponding to a first printing unit. Similarly, a reference numeral "2" is given, after the hyphen "-", to each component corresponding to a second printing unit and a reference numeral "3" is given, after the hyphen "-", to each component corresponding to a third printing unit. In addition, when the description is common to components, the hyphen "-" and following reference numerals are not given to the components.

The ink jet printer 1 (corresponding to a liquid discharging apparatus) in the embodiment can discharge three kinds of ink, and thus the ink jet printer 1 has three printing units. One printing unit includes a steering mechanism 30, a head 40 (corresponding to a liquid discharging portion), a drying device 51 (corresponding to a drying portion), a first cooling device 61, a second cooling device 62, a heat insulator 63, a dancer roll 70, and a side edge position detecting sensor 81.

Furthermore, the ink jet printer 1 includes a rotating drum 10 (corresponding to a supporting portion), a feeding roller 21, a winding roller 22, and a controller 90.

Heads 40-1 to 40-3, steering mechanism 30-1 to 30-3, and a detector group 80 including the side edge position detecting sensor 81 are connected to the controller 90, as illustrated in FIG. 3. In addition, the controller 90 is connected to a computer 100.

The rotating drum 10 of the ink jet printer 1 of the embodiment has a medium M be wound around an outer peripheral surface thereof. When the rotating drum 10 rotates, the medium M is transported. A shaft center direction of the rotating drum 10 is parallel to the Y-axis direction. The rotating drum 10 is a rotating drum extending in the Y-axis direction.

The feeding roller 21 feeds a paper sheet as an example of the medium M to the rotating drum 10. In addition, the winding roller 22 receives the paper sheet on which printing is performed.

The steering mechanism 30 includes a first roller 31 and a second roller 32. Furthermore, the drying device 51 is provided in the steering mechanism 30. The details of the steering mechanism will be described below, with reference to FIGS. 4 and 5.

The head 40 is disposed on an upper portion of the rotating drum 10 and on a below-described course of the medium M. However, the disposition of the head 40 is not limited to the upper portion of the rotating drum 10 as long as the head 40 faces the outer peripheral surface of the rotating drum 10 and can discharge the ink onto the medium M.

The first roller 31 of the steering mechanism 30 is provided below the rotating drum 10 and on a +X-axis direction side. In addition, the second roller 32 of the steering mechanism 30 is provided below the rotating drum 10 and on a −X-axis direction side. A shaft center of the first roller 31 and a shaft center of the second roller 32 are arranged at angles at which each of the shaft centers thereof is not parallel to a shaft center of the rotating drum 10. The second roller 32 is arranged to be shifted further on a +Y-axis side than the first roller 31.

The first roller 31 changes a transport direction of the medium M which is fed from the rotating drum 10 such that the transport direction inclines with respect to the X-axis direction. In this case, the X-axis direction of the transport direction is changed to the −X direction and the Y-axis direction thereof is changed to the +Y direction.

The second roller 32 has the medium M, which is fed from the drying device 51, be wound therearound, and thus the second roller 32 changes the course of the medium M. In this case, the course of the medium M is changed so as to be parallel to an outer peripheral direction of the rotating drum 10. Accordingly, the medium can be wound around one rotating drum 10 multiple times.

The drying device 51 is disposed under the rotating drum 10 and between the first roller 31 and the second roller 32. The drying device 51 dries the ink on the medium M which travels between the first roller 31 and the second roller 32. The drying device 51 is accommodated in the steering mechanism 30 described below.

The heat insulator 63 is disposed between the rotating drum 10 and the drying device 51. In addition, the first cooling device 61 is disposed under a center axis of the rotating drum 10 and above the first roller 31. Further, the first cooling device 61 is disposed further on the +X-axis direction than the rotating drum 10. The first cooling device 61 cools the medium M which travels between the rotating drum 10 and the first roller 31.

Furthermore, the second cooling device 62 is disposed under the center axis of the rotating drum 10 and above the second roller 32. Further, the second cooling device 62 is disposed further on the −X-axis direction than the rotating drum 10. The second cooling device 62 cools the medium M which travels between the rotating drum 10 and the second roller 32.

The dancer roll 70 is a device which applies tension to the medium M. A dancer roll 70-1 of the first printing unit is disposed between the feeding roller 21 and the head 40-1.

Meanwhile, each of dancer rolls 70-2 and 70-3 of the second printing unit and the third printing unit is provided between the second roller 32 and the head 40. A configuration of the dancer roll 70 will be described below.

The side edge position detecting sensor 81 is disposed on an upstream side of the head 40 and in a vicinity of a side edge position of the medium M. Therefore, the side edge position detecting sensor 81-1 of the first printing unit detects a position of the side edge of the medium M and sends information on the position of the side edge to the controller 90, and thus the controller 90 can acquire the position of the medium M in the vicinity of the head 40-1. Similarly, the side edge position detecting sensors 81-2 and 81-3 of the second printing unit and the third printing unit detect the positions of the side edge of the medium M, and thus the controller 90 can acquire the positions of the medium M in the vicinities of the heads. Based on the information described above, the controller 90 can control rotation angles of the steering mechanisms 30-1 and 30-2.

The steering mechanism 30 is disposed to incline with respect to the X axis, as illustrated in FIG. 2. A plurality (three in this embodiment) of the steering mechanisms 30 are aligned in the Y-axis direction.

In the ink jet printer 1 configured as above, the medium M fed from the feeding roller 21 is, first, wound around an upper portion of the rotating drum 10 which is located below the head 40-1. Then, the head 40-1 discharges the ink onto the medium M. Next, the medium M is wound around a first roller 31-1. Subsequently, a travel direction of the medium M which is wound around the first roller 31-1 is changed as illustrated in FIG. 2.

Then, the medium M passes through a drying device 51-1. Therefore, the ink that lands on the medium M is dried. Next, the medium M is wound around a second roller 32-1. Subsequently, the travel direction of the medium M which is wound around the second roller 32-1 is changed to be parallel to the X-axis direction.

Then, the medium M passes through the heads 40-2 and 40-3 in such a manner that the medium M is subjected to the similar transporting processes described above. Therefore, printing is performed on the medium M. Three printing units are provided in the embodiment, and thus the printing is performed using three kinds of ink. When the printing is finished, the medium M is wound around the winding roller 22.

Figure 4:
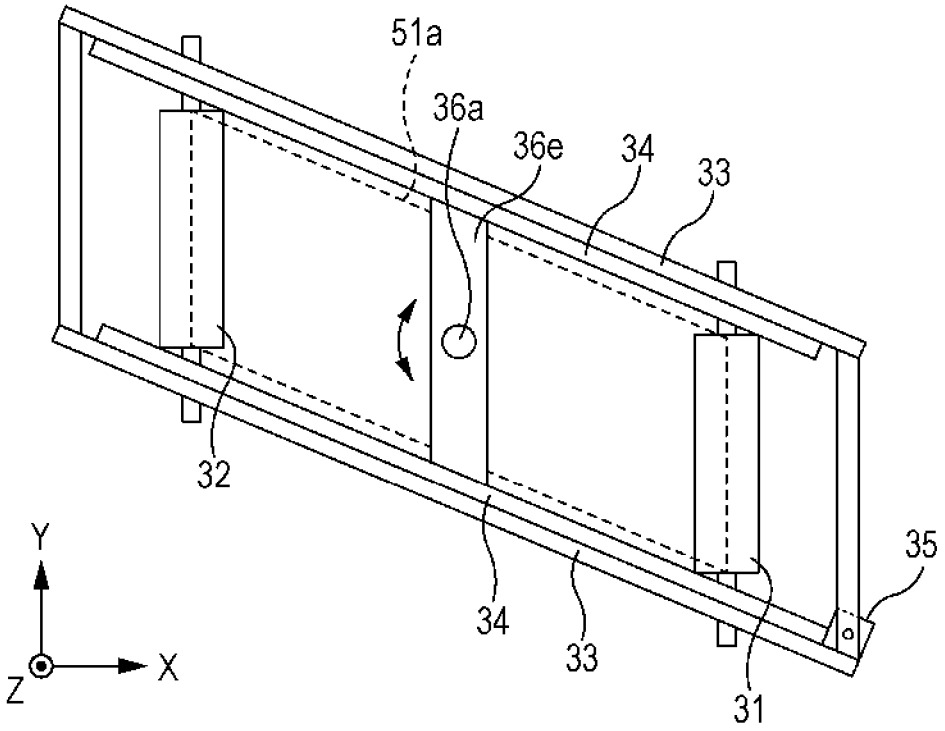
FIG. 4 is a plan view of a steering mechanism.
Figure 5:
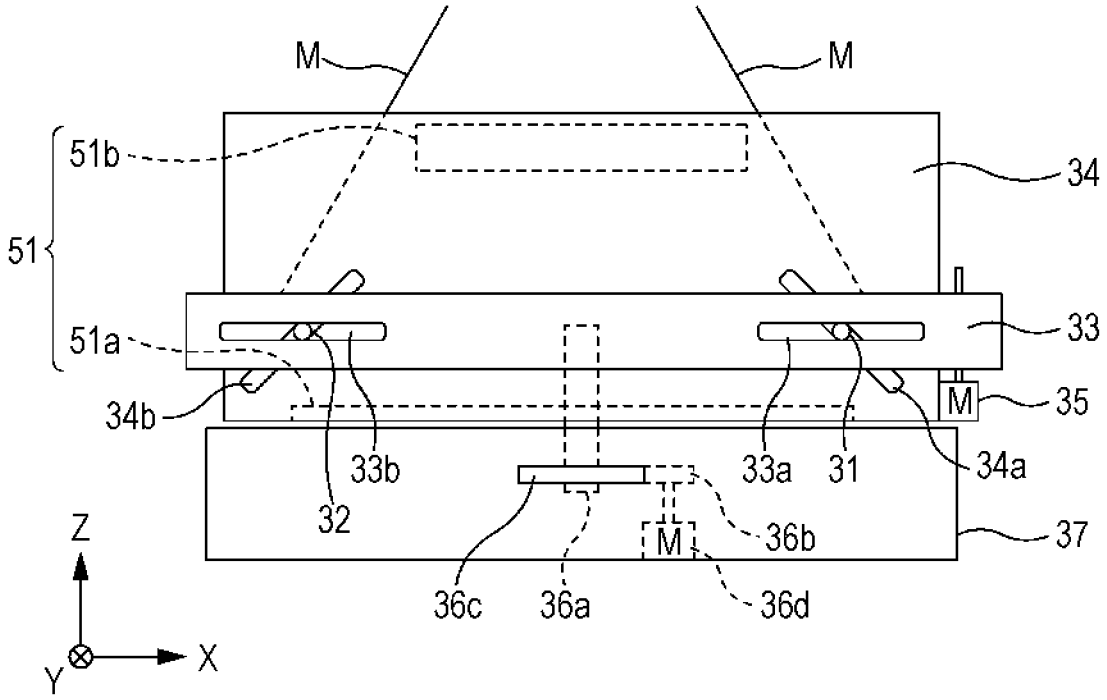
FIG. 5 is a side view of the steering mechanism.

FIG. 4 is a plan view of the steering mechanism 30. FIG. 5 is a side view of the steering mechanism 30. For convenience of description, an X axis, a Y axis, and a Z axis are illustrated in FIGS. 4 and 5, as similar to the drawings described above.

The steering mechanism 30 includes the first roller 31, the second roller 32, an outer frame 33, and an inner frame 34. The steering mechanism 30 includes a vertical movement motor 35, a rotating mechanism 36, and a base 37. In addition, the drying device 51 (corresponding to the drying portion) is provided in the steering mechanism 30.

The outer frame 33 and the inner frame 34 are frames which rotatably hold the first roller 31 and the second roller 32. The outer frame 33 and the inner frame 34 in which the first roller 31 and the second roller 32 are installed correspond to a transport portion.

In the plan view illustrated in FIG. 4, the outer frame 33 is disposed to surround a periphery of the inner frame 34. The outer frame 33 includes an outer slide hole 33*a* which holds a shaft of the first roller 31, and an outer slide hole 33*b* which holds a shaft of the second roller 32, as illustrated in FIG. 5. The outer slide holes 33*a* and 33*b* are slide holes extending in a longitudinal direction of the frame.

The inner frame 34 includes an inner slide hole 34*a* which holds a shaft of the first roller 31, an inner slide hole 34*b* which holds a shaft of the second roller 32. The inner slide holes 34*a* and 34*b* are slide holes which extend, in the longitudinal direction, from an outside lower portion to an inside upper portion of the frame.

Furthermore, the vertical movement motor 35 is fixed to an end portion of the inner frame 34. An output shaft of the vertical movement motor 35 and the outer frame 33 are connected via a ball screw spline mechanism which converts a rotational movement of the vertical movement motor 35 to a vertical movement. When the controller 90 causes the vertical movement motor 35 to rotate, a position of the outer frame 33 is displaced in a vertical direction.

When the outer frame 33 moves upward, the first roller 31 passing through the outer slide hole 33*a* moves upward. However, the movement direction thereof is regulated by the inner slide hole 34*a*, the first roller 31 moves upward and moves toward the inside of the inner frame 34. Similarly, when the outer frame 33 moves upward, the second roller 32 passing through the outer slide hole 33*b* moves upward. However, the movement direction thereof is regulated by the inner slide hole 34*b*, the second roller 32 moves upward and moves toward the inside of the inner frame 34.

Figure 6A:
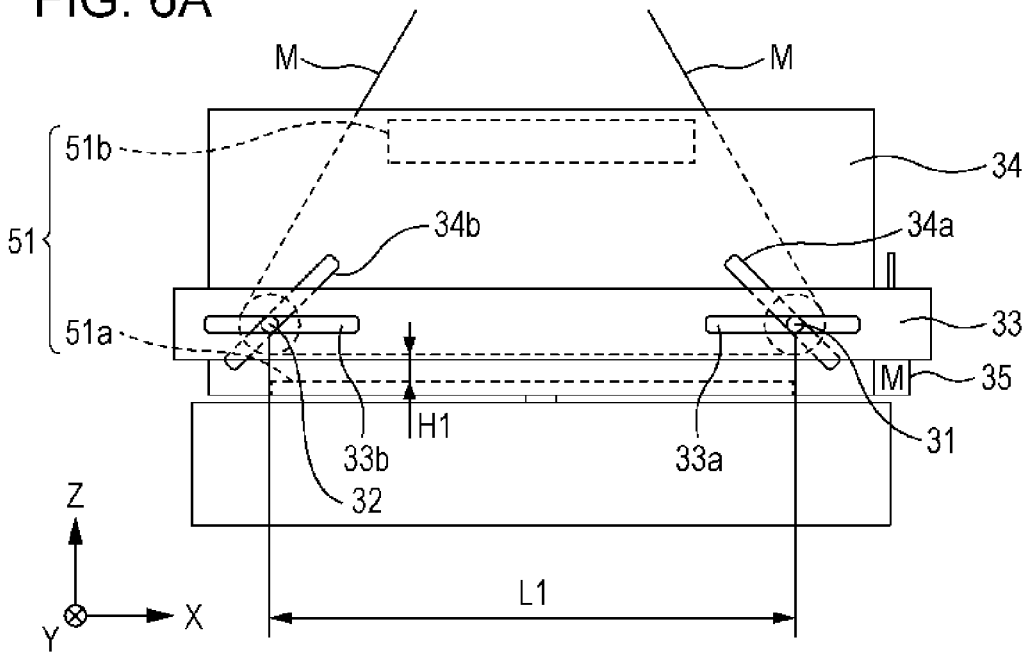
FIGS. 6A and 6B are explanatory views illustrating variable lengths of a drying path in the embodiment.
Figure 6B:
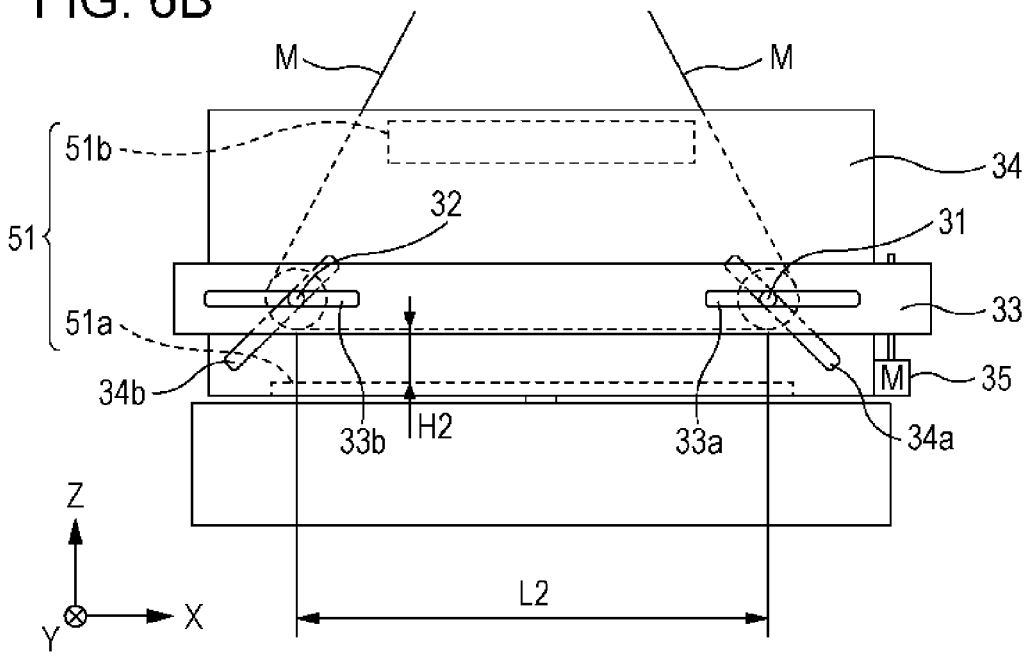

FIG. 6A is an explanatory view illustrating a length of a first drying path. FIG. 6B is an explanatory view illustrating a length of a second drying path. When the outer frame 33 moves upward or downward, as described above, a distance between the first roller 31 and the second roller 32 is changed. A hot air blowing unit 51*a* is provided between the first roller 31 and second roller 32 and below a medium transport path. In addition, the drying path of the medium M is formed between the first roller 31 and the second roller 32. When the outer frame 33 is lowered to the maximum, the length of the drying path is L1, as illustrated in FIG. 6A.

On the contrary, when the outer frame 33 is lifted to the maximum, as illustrated in FIG. 6B, the length of the drying path is L2. The length L2 of the drying path is shorter than the length L1 of the drying path. Furthermore, a distance between the hot air blowing unit 51*a* and the medium M is H1, as illustrated in FIG. 6A. When the outer frame 33 is lifted to the maximum, the distance between the hot air blowing unit 51*a* and the medium M is H2. The distance H2 is longer than the distance H1.

When a heat quantity emitted from the hot air blowing unit 51*a* is constant, the length of the drying path through which the medium M passes, which is illustrated in FIG. 6A, is longer than the length thereof illustrated in FIG. 6B. Further, the distance between the hot air blowing unit 51*a* to the medium M, which is illustrated in FIG. 6A, is shorter than the distance therebetween illustrated in FIG. 6B. In other words, the heat quantity applied to the medium M can be changed by moving the outer frame 33 in the vertical direction. Furthermore, it is possible to change the heat quantity in accordance with a kind of ink discharged from the head 40.

The steering mechanism 30 includes the rotating mechanism 36 which causes the outer frame 33 and the inner frame 34 to rotate around the Z axis. The rotating mechanism 36 includes a rotating shaft 36*a*, a primary gear 36*b*, a secondary gear 36*c*, a rotation motor 36*d*, and a beam member 36*e*. A part of the rotating shaft 36*a*, the primary gear 36*b*, the secondary gear 36*c* and the motor 36*d* are accommodated in the base 37.

The beam member 36*e* is fixed to the frames in which the inner slide holes 34*a* and 34*b* are formed so as to be suspended across the frames. One end of the rotating shaft 36*a* is fixed to the center of the beam member 36*e*. The secondary gear 36*c* is coaxially fixed to the other end of the rotating shaft 36*a*. Meanwhile, the motor 36 is fixed to the base 37 and the primary gear 36*b* is coaxially fixed to the output shaft of the motor 36*d*. The primary gear 36*b* and the secondary gear 36*c* are engaged with each other, and thus torque of the motor 36*d* is transmitted to the rotating shaft 36*a*. Therefore, the inner frame 34 rotates in the Z-axis direction. The controller 90 controls the rotation of the motor 36*d*. The controller 90 can control the angles of the first roller 31 and the second roller 32 by control the rotation angles of the motor 36*d*.

The drying device 51 is provided in the inner frame 34. The hot air blowing unit 51*a* is provided below the inner frame 34. The hot air blowing unit 51*a* blows hot air to the medium M which passes over the hot air blowing unit 51*a*, and thus drying of the ink is encouraged. In addition, a hot air receiving unit 51*b* is provided above the inner frame 34. The heat from the hot air blowing unit 51*a* or the like is drawn out through the hot air receiving unit 51*b*.

Figure 7:
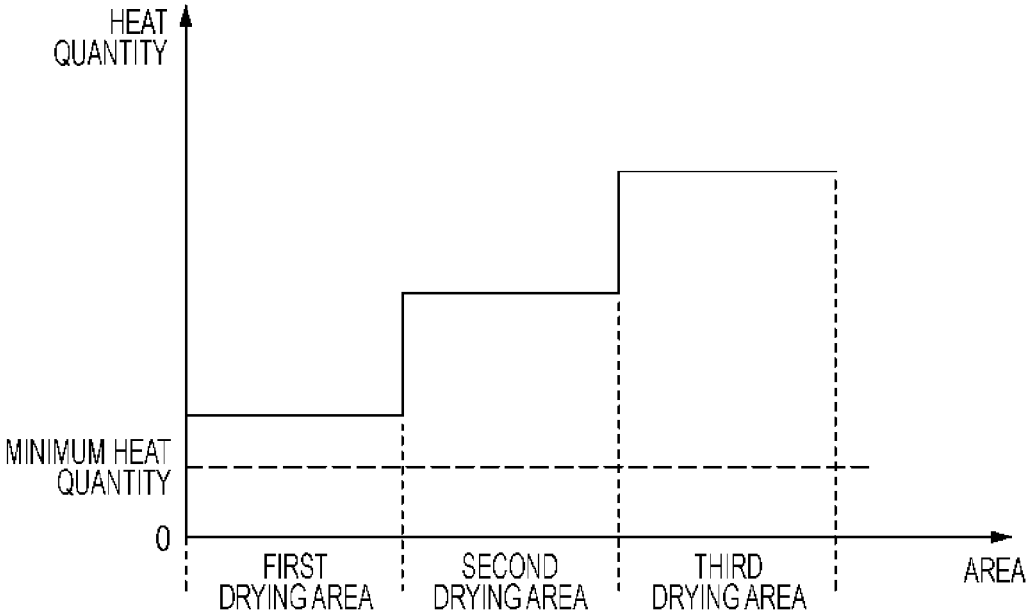
FIG. 7 is an explanatory view illustrating a heat quantity in the embodiment.

FIG. 7 is an explanatory view illustrating a heat quantity in the embodiment. In FIG. 7, a first drying area shows a drying area in the steering mechanism 30-1 of the first printing unit and a second drying area shows a drying area in the steering mechanism 30-2 of the second printing unit. Further, a third drying area shows a drying area in the steering mechanism 30-3 of the third printing unit. A heat quantity of a vertical axis is a heat quantity which is applied to the medium M in each drying area.

The minimum heat quantity illustrated in FIG. 7 is the minimum applied heat quantity by which the ink is prevented from being blurred when the head 40-2 discharges the ink on the ink which is discharged by the head 40-1 and lands on the medium M. The heat quantity in the first drying area is set not to be lower than the minimum heat quantity. Accordingly, the ink is prevented from being blurred on the medium M, and thus it is possible to improve the quality of the printed image.

In the downstream side of the transport direction, part of the medium M, which is located on a downstream side in the transport direction, passes through a drying path in another steering mechanism again. Therefore, when the medium M passes through a first drying path, it is sufficient as long as the heat quantity is applied more than the minimum heat quantity. The heat quantity increases stepwise, and, finally, the completely dried medium is output.

The heat quantity applied to the medium M can be changed by moving, in the vertical direction, the outer frame 33 of the steering mechanism 30, as described above. Therefore, a position of the outer frame 33 in the steering mechanism 30-2 of the second printing unit is set to be lower than that in the steering mechanism 30-1 of the first printing unit. In addition, a position of the outer frame 33 in the steering mechanism 30-3 of the third printing unit is set to be lower than that in the steering mechanism 30-2 of the second printing unit. A vertical position of each outer frame 33 is set, as described above, and thus the heat quantity can be set as illustrated in FIG. 7.

In addition, the vertical position of the outer frame 33 can be regulated based on image data of a print job which is sent from the computer 100 connected to the ink jet printer 1. For example, the controller 90 analyzes the received image data and if an ink discharging amount by the head 40-1 is large, the vertical position of the outer frame in the steering mechanism 30-1 can be adjusted (in this case, the length of the drying path is extended) to be lowered. On the contrary, the controller 90 analyzes the image data and if an ink discharging amount by the head 40-1 is small, the vertical position of the outer frame in the steering mechanism 30-1 can be adjusted (in this case, the length of the drying path is shortened) to be raised.

Furthermore, the vertical position of the outer frame 33 can be changed in accordance with a type of a used medium M. For example, when a glossy paper sheet on which the ink is difficult to be dried is used as a medium, the vertical position of the outer frame 33 can be adjusted (in this case, the length of the drying path is extended) to be lowered as a whole. On the contrary, when a medium into which the ink is easily absorbed is used, the vertical position of the outer frame 33 can be adjusted (in this case, the length of the drying path is shortened) to be raised as a whole. The heat quantity applied to the medium is changed for each medium, as described above, it is possible to adjust the thermal effect on the medium.

Figure 8:
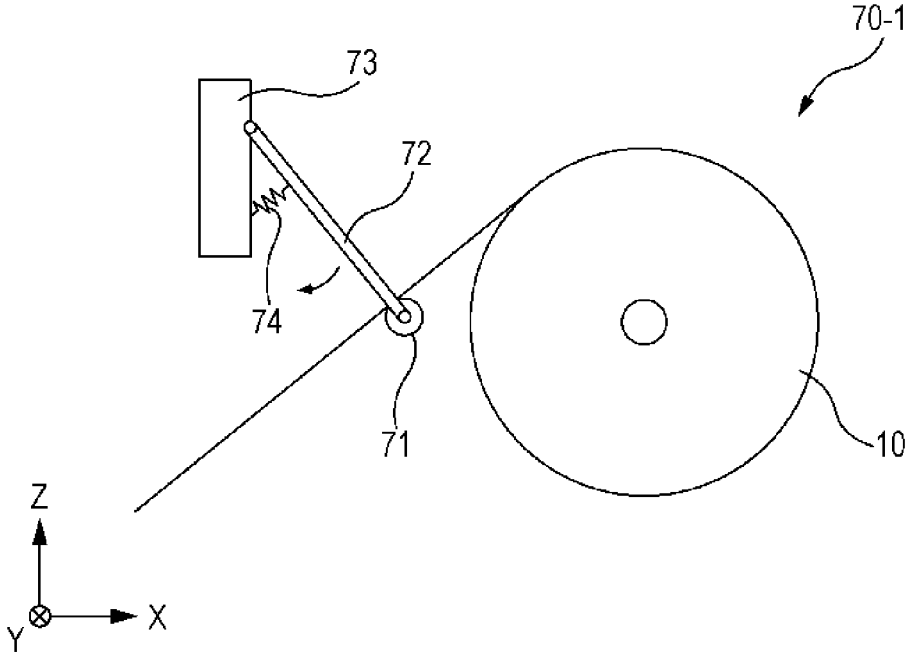
FIG. 8 is an explanatory view of a dancer roll.

FIG. 8 is an explanatory view of a dancer roll 70. The dancer roll 70 is a device applying tension to the medium M. The dancer roll 70 includes a driven roller 71, a holding bar 72, a fixing wall 73, and a spring 74.

The driven roller 71 is held in one end of the holding bar 72 in a state where the driven roller 71 is rotatable around the Y axis. It is preferable that the holding bars 72 be provided at both ends of a rotating shaft of the driven roller 71. The other ends of the holding bars 72 are attached to the fixing wall in a state where the holding bars 72 are rotatable around the Y axis. The fixing wall 73 may be, for example, a frame in the ink jet printer 1. One end of the spring 74 is fixed to the holding bar 72. In addition, the other end of the spring 74 is fixed to the fixing wall 73. Thus, a force is applied to the holding bar 72 so as to pull the holding bar 72 toward the fixing wall 73 side. The driven roller 71 is put on a back surface side of the medium M.

The ink jet printer 1 is configured as above, and thus a force which pulls the medium M to the fixing wall 73 side is applied to the medium M in a state where the driven roller 71 is put on the back surface side of the medium M. As a result, tension is generated between the dancer roll 70 and the rotating drum 10. Thus, even when an approach angle of the medium is slightly changed by the steering mechanism 30, the transport direction of the medium M can be appropriately corrected on the rotating drum 10 such that the transport direction of the medium M is parallel to the outer peripheral direction of the rotating drum 10.

Figure 9:
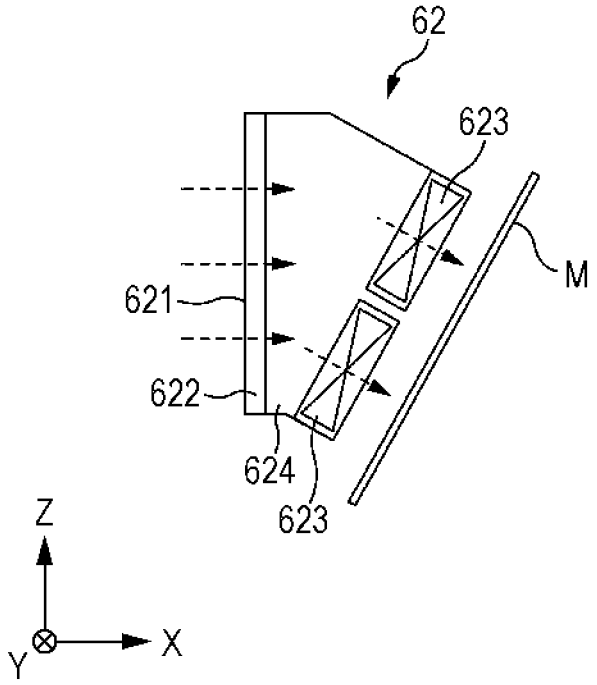
FIG. 9 is an explanatory view of a second cooling device.

FIG. 9 is an explanatory view of the second cooling device 62. The first cooling device 61 described above has the same configuration as the second cooling device 62. Thus, the second cooling device 62 will be described as an example. The second cooling device 62 includes a duct 624, and a filter 622 and a cooling fan 623 in the duct 624. An arrow illustrated by the dashed line in FIG. 9 shows a path of air.

The filter 622 is attached to an outside air intake port 621 which is located on one end side of the duct 624. A plurality of the cooling fans 623 are installed on the other end side of the duct 624. The cooling fan 623 is installed in a direction where the cooling fan 623 can blow air to the medium M, and thus the air taken in from the outside air intake port 621 is blown to the medium M. Accordingly, the air cools down a temperature of the medium M which is warmed by the drying device 51 described above.

Other Embodiments

In the embodiment described above, the ink jet printer 1 is described as a liquid discharging apparatus. However, without being limited thereto, the liquid discharging apparatus can be embodied in a liquid discharging apparatus which ejects or discharges fluid (liquid, liquid material in which particles of a functional material are dispersed, fluid material such as a gel) other than ink. A piece of technology similar to the embodiment described above may be applied to various types of devices using an ink jet technology, such as a color filter manufacturing device, a dyeing device, a fine processing device, a semiconductor manufacturing device, a surface processing device, a three-dimensional molding machine, a gas vaporizer device, an organic EL manufacturing device (particularly, a macromolecular EL manufacturing device), a display manufacturing device, a film forming device, and a DNA chip manufacturing device. Also, these methods or manufacturing method are within the scope of application.

Head

In the embodiment described above, the ink can be discharged using a piezoelectric element. However, a liquid discharging method is not limited thereto. Other methods, for example, a method in which bubbles are generated in nozzles by applying heat may be applied.

The embodiments described above are intended to facilitate the understanding of the invention, and are not intended to be construed as limiting the invention. The invention can be changed or modified insofar as it is within the scope of the invention. Needless to say, the invention includes equivalents thereof.

The entire disclosure of Japanese Patent Application No. 2013-065802, filed Mar. 27, 2013 is expressly incorporated by reference herein.

What is claimed is:

1. A liquid discharging apparatus comprising:

a supporting portion that supports a medium, wherein the supporting portion includes a rotating drum that transports the medium in a state where the medium is wound around an outer peripheral surface of the rotating drum;

a liquid discharging portion that discharges liquid onto the medium which is transported on the supporting portion;

a drying portion that has a drying path through which the medium passes and dries the liquid landing on the medium;

a first roller that directs the medium which passes through the rotating drum to the drying path; and a second roller that directs the medium which passes through the drying path to the rotating drum again, wherein the drying path is a transport path of the medium, which extends from the first roller to the second roller, and wherein the first roller and second roller are supported by a frame, the frame being configured to slide in a first direction relative to the rotating drum and move the first roller and the second roller in a second direction transverse to the first direction to change a length of the drying path.

2. The liquid discharging apparatus according to claim 1, wherein the length of the drying path, which is adequate for drying the liquid, is acquired by analyzing received image data of a print job, and then the distance between the first roller and the second roller is controlled in accordance with the acquired length of the drying path.

3. The liquid discharging apparatus according to claim 1, wherein an angle of an axis of the first roller and an angle of an axis of the second roller are shifted with respect to a shaft of the rotating drum, and thus the medium is able to be wound in an axial direction of the rotating drum multiple times.

4. The liquid discharging apparatus according to claim 1, wherein the liquid discharging portion includes a first liquid discharging portion that discharges a first liquid onto the medium, and a second liquid discharging portion that discharges a second liquid onto the medium, wherein the drying portion includes a first drying portion that dries the first liquid landing on the medium, and a second drying portion that is disposed further on a downstream side of the medium transport path than the first drying portion and dries the second liquid landing on the medium, and wherein a length of the drying path of the first drying portion is shorter than a length of the drying path of the second drying portion.

5. The liquid discharging apparatus according to claim 4, wherein a heat quantity applied to the medium in the drying path of the first drying portion is equal to or more than a heat quantity by which the liquid is prevented from being blurred when the second liquid lands on the first liquid landing on the medium.

6. The liquid discharging apparatus according to claim 1, wherein the length of the drying path is changed in accordance with a type of the medium.

7. The liquid discharging apparatus according to claim 1, wherein a distance between a heat source and the medium is variable in the drying portion.

* * * * *